US012291308B2

(12) United States Patent
Ohiso

(10) Patent No.: US 12,291,308 B2
(45) Date of Patent: May 6, 2025

(54) BOAT

(71) Applicant: HONDA MOTOR CO., LTD., Tokyo (JP)

(72) Inventor: Keiichi Ohiso, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 513 days.

(21) Appl. No.: 17/702,829

(22) Filed: Mar. 24, 2022

(65) Prior Publication Data

US 2022/0306243 A1 Sep. 29, 2022

(30) Foreign Application Priority Data

Mar. 26, 2021 (JP) ..... 2021-053273

(51) Int. Cl.

| | |
|---|---|
| ***B63B 17/00*** | (2006.01) |
| ***B63B 35/34*** | (2006.01) |
| ***B63H 21/17*** | (2006.01) |
| *B63B 1/14* | (2006.01) |

(52) U.S. Cl.

CPC ..... *B63B 17/0081* (2013.01); *B63B 35/34* (2013.01); *B63H 21/17* (2013.01); *B63B 1/14* (2013.01)

(58) Field of Classification Search

CPC ..... B63B 17/0081; B63B 35/34; B63B 1/14; B63B 2001/145; B63H 21/17

See application file for complete search history.

(56) References Cited

FOREIGN PATENT DOCUMENTS

| | | | |
|---|---|---|---|
| JP | 2009-519180 | | 5/2009 |
| JP | 2015071401 A | * | 4/2015 |
| JP | 6757526 B2 | * | 9/2020 |
| WO | 2007/070657 | | 6/2007 |

* cited by examiner

*Primary Examiner* — Anthony D Wiest

(74) *Attorney, Agent, or Firm* — Amin, Turocy & Watson, LLP

(57) ABSTRACT

A boat includes: a hull; a float that supports the hull; a suspension that is disposed between the hull and the float and absorbs a vibration transmitted from the float to the hull; and a conversion mechanism that converts an energy generated in accordance with a relative movement of the hull and the float in a vertical direction, wherein the conversion mechanism is arranged so as to sandwich a center of gravity of the hull in a forward-rearward direction.

3 Claims, 7 Drawing Sheets

BOAT

CROSS-REFERENCE TO RELATED APPLICATION

Priority is claimed on Japanese Patent Application No. 2021-053273, filed on Mar. 26, 2021, the contents of which are incorporated herein by reference.

BACKGROUND

Field of the Invention

The present invention relates to a boat.

Background

Published Japanese Translation No. 2009-519180 of the PCT International Publication discloses a boat (pontoon boat) including a hull and a float (pontoon).

SUMMARY

In the configuration of Published Japanese Translation No. 2009-519180 of the PCT International Publication, there is a problem that since the hull is directly fixed to the float, vibration transmitted from the float to the hull cannot be absorbed.

An object of an aspect of the present invention is to provide a boat capable of absorbing vibration transmitted from a float to a hull.

A boat according to an aspect of the invention includes: a hull; a float that supports the hull; a suspension that is disposed between the hull and the float and absorbs a vibration transmitted from the float to the hull; and a conversion mechanism that converts an energy generated in accordance with a relative movement of the hull and the float in a vertical direction, wherein the conversion mechanism is arranged so as to sandwich a center of gravity of the hull in a forward-rearward direction.

According to the aspect described above, it becomes possible for the suspension to absorb the vibration transmitted from the float to the hull. Further, the conversion mechanism is arranged so as to sandwich the gravity center of the hull in the forward-rearward direction, and thereby, it is also possible to generate electricity while absorbing the vibration by using front and rear conversion mechanisms in accordance with the vertical movement of front and rear parts of the hull with respect to the float when the boat navigates.

When a distance from the center of gravity of the hull to the conversion mechanism located at a rearward position is X, and a distance from the center of gravity of the hull to the conversion mechanism located at a forward position is Y, a relationship of X>Y may be satisfied.

In this case, depending on the use mode of the boat, when the rear part of the boat is to sink significantly, it is possible to reduce a load generated on the rear conversion mechanism.

The conversion mechanism may include a motor that generates an electric energy in accordance with the relative movement of the hull and the float in the vertical direction, the motor may be electrically connected to a battery, and a center of gravity of the battery and a center of gravity of the hull may match with each other in the forward-rearward direction.

In this case, by matching the center of gravity of the heavy battery with the center of gravity of the hull, it is possible to prevent a moment from acting on the boat by the presence of the battery and to stabilize the attitude of the boat.

The conversion mechanism may include: a rack gear that is fixed to the float and is movable upward and downward relative to the boat; a pinion gear that engages with the rack gear; and a motor having a rotation shaft to which the pinion gear is fixed, the hull may include a battery that is electrically connected to the motor, the rotation shaft may extend in a direction perpendicular to the vertical direction, and a size of the motor may be smaller than a size of the battery in the vertical direction.

In this case, it is possible to prevent the size of the hull from increasing in the vertical direction due to the presence of the motor. Further, it is possible to easily arrange the battery and the motor in a common storage room. By arranging the motor in the storage room together with the battery, the waterproof structure of the hull can be simplified, and the wiring for connecting the battery to the motor can be shortened.

The conversion mechanism may include: a rack gear that is fixed to the float and is movable upward and downward relative to the hull; a motor having a rotation shaft; and a gear train that connects the rotation shaft to the rack gear, the hull may include a battery that is electrically connected to the motor, and the rotation shaft may extend in the vertical direction.

In this case, the proprietary area of the conversion mechanism can be made small when seen from the vertical direction. Thereby, it is possible to further effectively utilize the space of the hull.

According to the above aspect of the present invention, it is possible to provide the boat capable of absorbing the vibration transmitted from the float to the hull.

DESCRIPTION OF EMBODIMENTS

First Embodiment

Figure 1:
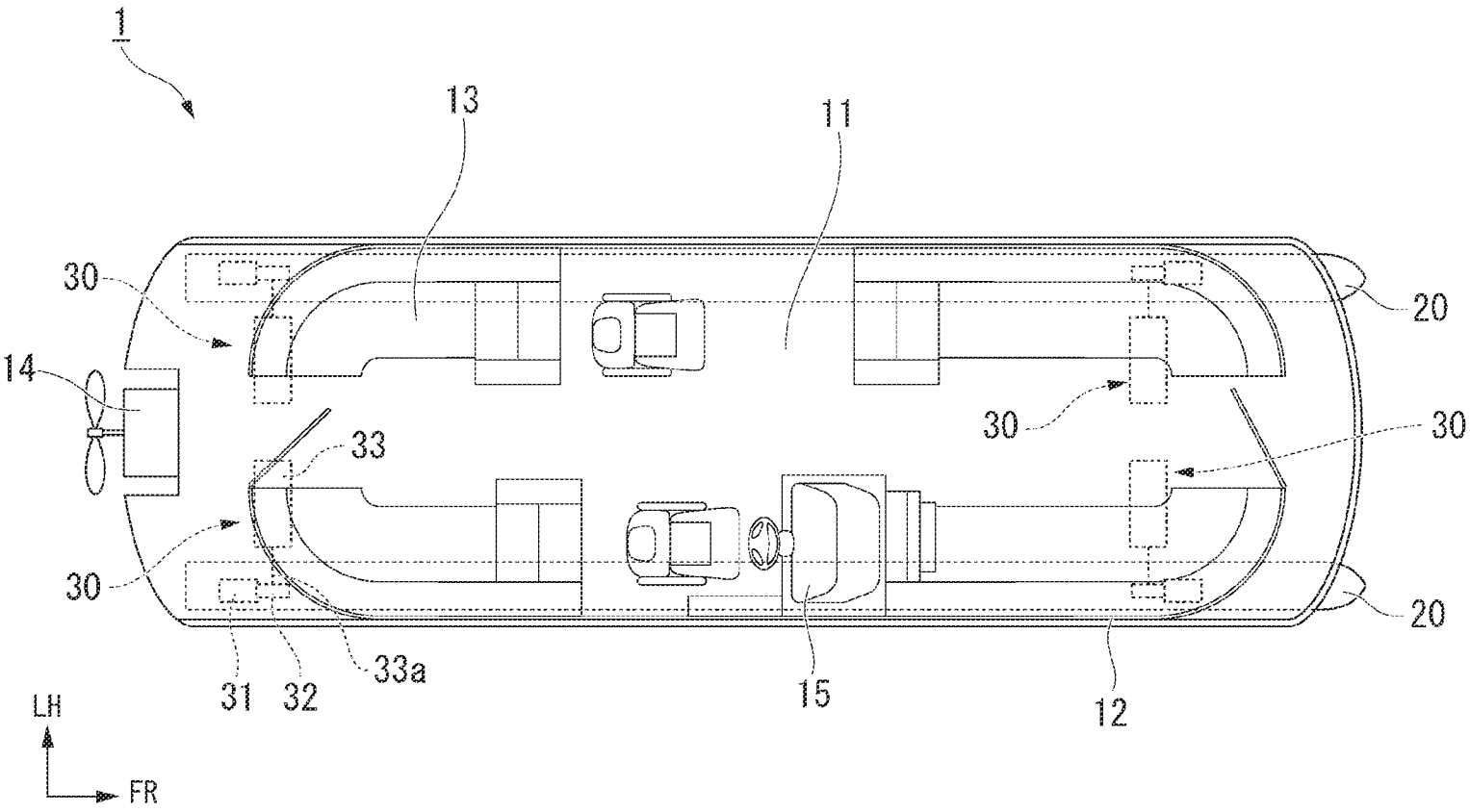
FIG. 1 is a top view of a boat according to a first embodiment.

Hereinafter, a boat of a first embodiment will be described with reference to the drawings. Directions such as forward, rearward, rightward, and leftward directions in the following description are identical to directions in a boat 1 described below unless otherwise stated. Further, in an appropriate position in the drawings used in the following description, an arrow FR indicating a forward direction of the boat 1, an arrow LH indicating a leftward direction of the boat 1, and an arrow UP indicating an upward direction of the boat 1 are shown.

Figure 2:
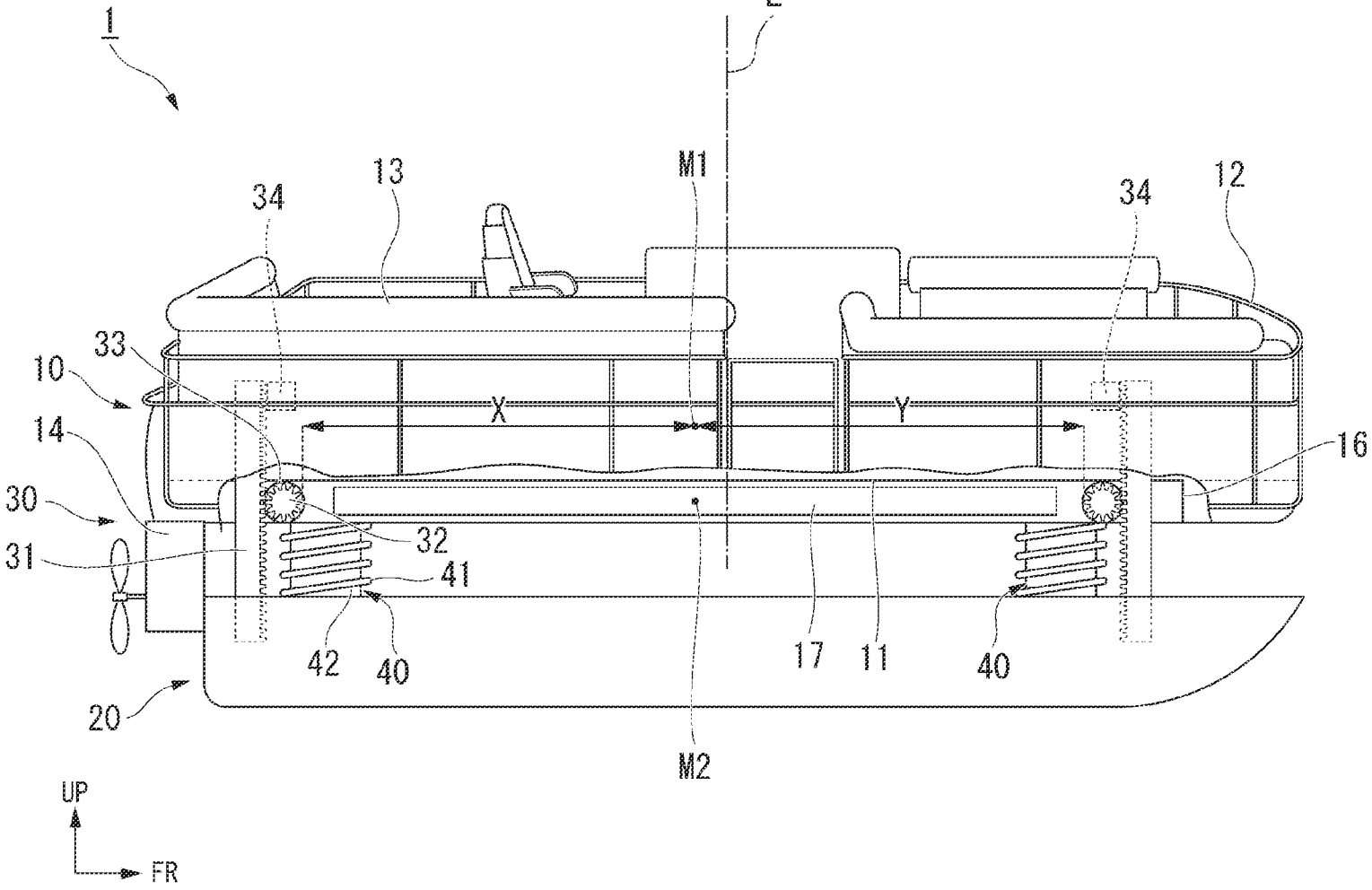
FIG. 2 is a side view of the boat of FIG. 1.

As shown in FIGS. 1 and 2, the boat 1 includes a hull 10, a float 20, a conversion mechanism 30, and a suspension 40.

The hull 10 includes a floor part 11, a fence 12, a seat 13, a propeller 14, a maneuvering part 15, and a storage room 16 (refer to FIG. 2). The floor part 11 is a part that supports the load of an occupant and a structure on the hull 10. The fence 12 is provided so as to surround the vicinity of an outer edge of the floor part 11 and extends upward from the floor part 11. The seat 13 is provided on the floor part 11. In the example of FIG. 1, the seat 13 is disposed at each of four corners of the floor part 11 having a substantially rectangular shape. The layout of the seat 13 and the like can be appropriately changed. The propeller 14 is provided on a rear end part of the hull 10 and outputs a thrust for the hull 10 to navigate. The propeller 14 includes a screw and is constituted such that the ON/OFF, the output, or the like is controlled by a command from the maneuvering part 15.

As shown in FIG. 2, the storage room 16 is provided on a lower part of the hull 10 (a part below the floor part 11). The storage room 16 has a waterproof structure to prevent water from entering the inside. A battery 17 and the like are disposed within the storage room 16.

The float 20 is provided below the hull 10. As shown in FIG. 1, in the present embodiment, the number of floats 20 included in the boat 1 is two. The two floats 20 extend in a forward-rearward direction and are arranged to be spaced from each other in a rightward-leftward direction. A buoyancy acts on the float 20. Due to this buoyancy, the float 20 supports the hull 10 through the conversion mechanism 30 and the suspension 40.

The conversion mechanism 30 converts the energy generated by the relative movement of the hull 10 and the float 20 in the vertical direction and generates another form of energy (for example, electric energy). The conversion mechanism 30 of the present embodiment includes a rack gear 31, a pinion gear 32, a motor 33, and a position sensor 34. The pinion gear 32 is fixed to a rotation shaft 33*a* of the motor 33. The motor 33 is fixed to the hull 10. More specifically, the motor 33 is accommodated in the storage room 16 together with the battery 17 and is electrically connected to the battery 17.

The rack gear 31 extends in the vertical direction and engages with the pinion gear 32. A lower end part of the rack gear 31 is fixed to the float 20. In order to cause the pinion gear 32 that is fixed to the motor 33 to engage with the rack gear 31 while ensuring the waterproof property of the storage room 16, for example, a structure in which the rotation shaft 33*a* penetrates through a wall of the storage room 16 may be employed. In this case, the waterproof property of the storage room 16 can be ensured by sealing the periphery of a part of the rotation shaft 33*a* that penetrates through the wall of the storage room 16.

When the hull 10 and the float 20 move relative to each other in the vertical direction, the rack gear 31 and the pinion gear 32 are also to move relative to each other in the vertical direction. At this time, the pinion gear 32 rotates while engaging with the rack gear 31. By the pinion gear 32 rotating the rotation shaft 33*a*, the motor 33 generates electric energy. This electric energy is stored in the battery 17. The electric energy stored in the battery 17 may be used for rotating the motor 33. By rotating the motor 33, the distance between the hull 10 and the float 20 in the vertical direction can be adjusted. The attitude of the hull 10 can also be controlled by separately controlling motors 33 respectively disposed at four positions at the front, rear, right, and left sides of the hull 10. Alternatively, the electric energy stored in the battery 17 may be used for other applications (for example, an electrical power source of an electrical product included in the hull 10, a power for the propeller 14, and the like).

In the present embodiment, the motor 33 has a cylindrical shape that extends in a direction perpendicular to the vertical direction. In FIG. 1, the motor 33 extends in the rightward-leftward direction. However, the motor 33 may extend in the forward-rearward direction or may extend obliquely relative to the forward-rearward direction and the rightward-leftward direction. The rotation shaft 33*a* also extends in the direction perpendicular to the vertical direction. As shown in FIG. 2, the size of the motor 33 in the vertical direction is smaller than the size of the battery 17 in the vertical direction. Therefore, the motor 33 can be arranged in the storage room 16 without increasing the size in the vertical direction of the storage room 16 in which the battery 17 is accommodated. The shape of the motor 33 can be changed appropriately and may be, for example, a rectangular shape or the like.

The position sensor 34 is attached to an upper end part of the rack gear 31. The position sensor 34 detects the position of the pinion gear 32 in the vertical direction relative to the rack gear 31. By detecting the position of the pinion gear 32 in the vertical direction, the distance between the hull 10 and the float 20 in the vertical direction can be indirectly measured. The measurement result by the position sensor 34 may be used when driving the motor 33 using the electric energy stored in the battery 17.

The suspension 40 includes a damper 41 and a spring 42. In the example of FIG. 1, a damper 41 having a rod shape is arranged on an inside of the spring 42. However, the structure of the suspension 40 can be appropriately changed, and, for example, the damper 41 may be arranged on an outside of the spring 42.

A virtual line L shown in FIG. 2 indicates the center position of the hull 10 in the forward-rearward direction. A point M1 indicates a center of gravity of the hull 10, and a point M2 indicates a center of gravity of the battery 17. The gravity center M1 of the hull 10 is located at a further rearward position than the virtual line L. By this arrangement, the boat 1 can be in a stern trim state. The stern trim refers to a state in which the draft of the stern is larger than the draft of the bow.

In the present embodiment, the conversion mechanism 30 and the suspension 40 are provided so as to sandwich the gravity center M1 of the hull 10 in the forward-rearward direction. As shown in FIG. 1, two conversion mechanisms 30 are provided for each float 20. Although omitted in FIG. 1, two suspensions 40 are also provided for each float 20. That is, the boat 1 includes four conversion mechanisms 30 and four suspensions 40. However, the number of conversion mechanisms 30 and suspensions 40 can be appropriately changed. For example, when the number of floats 20 is three, the conversion mechanism 30 and the suspensions 40 may be provided on front and rear end parts of each float 20 at a total of six positions. Alternatively, the conversion mechanism 30 and the suspension 40 may not be provided on part of the floats 20.

As shown in FIG. 2, in the forward-rearward direction, the distance to the rear conversion mechanism 30 from the gravity center M1 of the hull 10 is represented as X, and the distance to the front conversion mechanism 30 from the gravity center M1 is represented as Y. In a case of a relationship of X=Y, since loads applied on the front and rear conversion mechanisms 30 can be equalized at the time of vibration absorption, and the specification of the motor 33, the gear ratios of the rack gear 31 and the pinion gear 32, the specification of the spring 42, and the like can be equalized between front and rear parts, the conversion mechanism 30 and components of the peripheral structure can be shared between the front and rear parts, and it is possible to improve the production efficiency of the boat 1. Accordingly, the relationship of X=Y can be preferably used.

Further, depending on the use mode of the boat 1, the load of the rear conversion mechanism 30 may be larger than the load of the front conversion mechanism 30. For example, when a heavy structure such as a water slider is arranged at a rear end part of the hull 10, the center of gravity moves rearward, and the rear part of the hull 10 is to sink significantly. In order to maintain the hull 10 to be horizontal, a control is performed in which the rear conversion mechanism 30 is driven, and the vertical distance between the hull 10 and the float 20 at the rear part of the boat 1 is increased.

At this time, the load generated at the rear conversion mechanism 30 changes depending on the distance X described above. Specifically, when the distance to the rear conversion mechanism 30 from the gravity center M1 of the hull 10 is larger, the load required for the rear motor 33 to maintain the hull 10 to be horizontal can be decreased. In view of the center of gravity according to such a use mode, a relationship of X>Y may be used.

As described above, the boat 1 of the present embodiment includes: the hull 10; the float 20 that supports the hull 10; the suspension 40 that is disposed between the hull 10 and the float 20 and absorbs the vibration transmitted from the float 20 to the hull 10; and the conversion mechanism 30 that converts the energy generated in accordance with the relative movement of the hull 10 and the float 20 in the vertical direction, wherein the conversion mechanisms 30 are arranged so as to sandwich the center of gravity of the hull 10 in the forward-rearward direction. According to this configuration, it becomes possible for the suspension 40 to absorb the vibration transmitted from the float 20 to the hull 10. Further, the conversion mechanisms 30 are arranged so as to sandwich the gravity center M1 of the hull 10 in the forward-rearward direction, and thereby, it is also possible to generate electricity while absorbing the vibration by using the front and rear conversion mechanisms 30 in accordance with the vertical movement of the front and rear parts of the hull 10 with respect to the float 20 when the boat 1 navigates. Further, the vertical position of the boat 10 is increased by the presence of the suspension 40 and the conversion mechanism 30, the open ocean cruising performance of the boat 1 is improved, and it is also possible to improve the turning performance and the riding comfort at the time of turning.

Further, when the distance from the gravity center M1 of the hull 10 to the conversion mechanism 30 located at the rearward position is X, and the distance from the gravity center M1 of the hull 10 to the conversion mechanism 30 located at the forward position is Y, the relationship of X>Y may be satisfied. In this case, depending on the use mode of the boat 1, when the center of gravity moves rearward, and the rear part of the boat 1 is to sink significantly, it is possible to reduce the load generated on the rear conversion mechanism 30.

Further, the conversion mechanism 30 in the present embodiment includes the motor 33 that generates the electric energy in accordance with the relative movement of the hull 10 and the float 20 in the vertical direction, the motor 33 is electrically connected to the battery 17, and the center of gravity of the battery 17 and the center of gravity of the hull 10 match with each other in the forward-rearward direction. In this case, by matching the center of gravity of the heavy battery 17 with the center of gravity of the hull 10, it is possible to prevent a moment from acting on the boat 1 by the presence of the battery 17 and to stabilize the attitude of the boat 1.

Further, the conversion mechanism 30 includes: the rack gear 31 that is fixed to the float 20 and is movable upward and downward with respect to the hull 10; the pinion gear 32 that engages with the rack gear 31; and the motor 33 having the rotation shaft 33*a* fixed to the pinion gear 32, the hull 10 includes the battery 17 that is electrically connected to the motor 33, and the rotation shaft 33*a* extends in the direction perpendicular to the vertical direction. As shown in FIG. 2, the size of the motor 33 is smaller than the size of the battery 17 in the vertical direction. According to this configuration, it is possible to prevent the size of the hull 10 from increasing in the vertical direction due to the presence of the motor 33. Further, it is possible to easily arrange the battery 17 and the motor 33 in a common storage room 16. By arranging the motor 33 in the storage room 16 together with the battery 17, the waterproof structure of the hull 10 can be simplified, and the wiring for connecting the battery 17 to the motor 33 can be shortened.

Second Embodiment

Next, a second embodiment according to the present invention will be described, but the basic configuration is similar to that of the first embodiment. Therefore, the same reference numerals are given to the similar configuration, the description thereof will be omitted, and only different points will be described.

In the present embodiment, the structure and the arrangement of the conversion mechanism 30 are different from those of the first embodiment.

Figure 3:
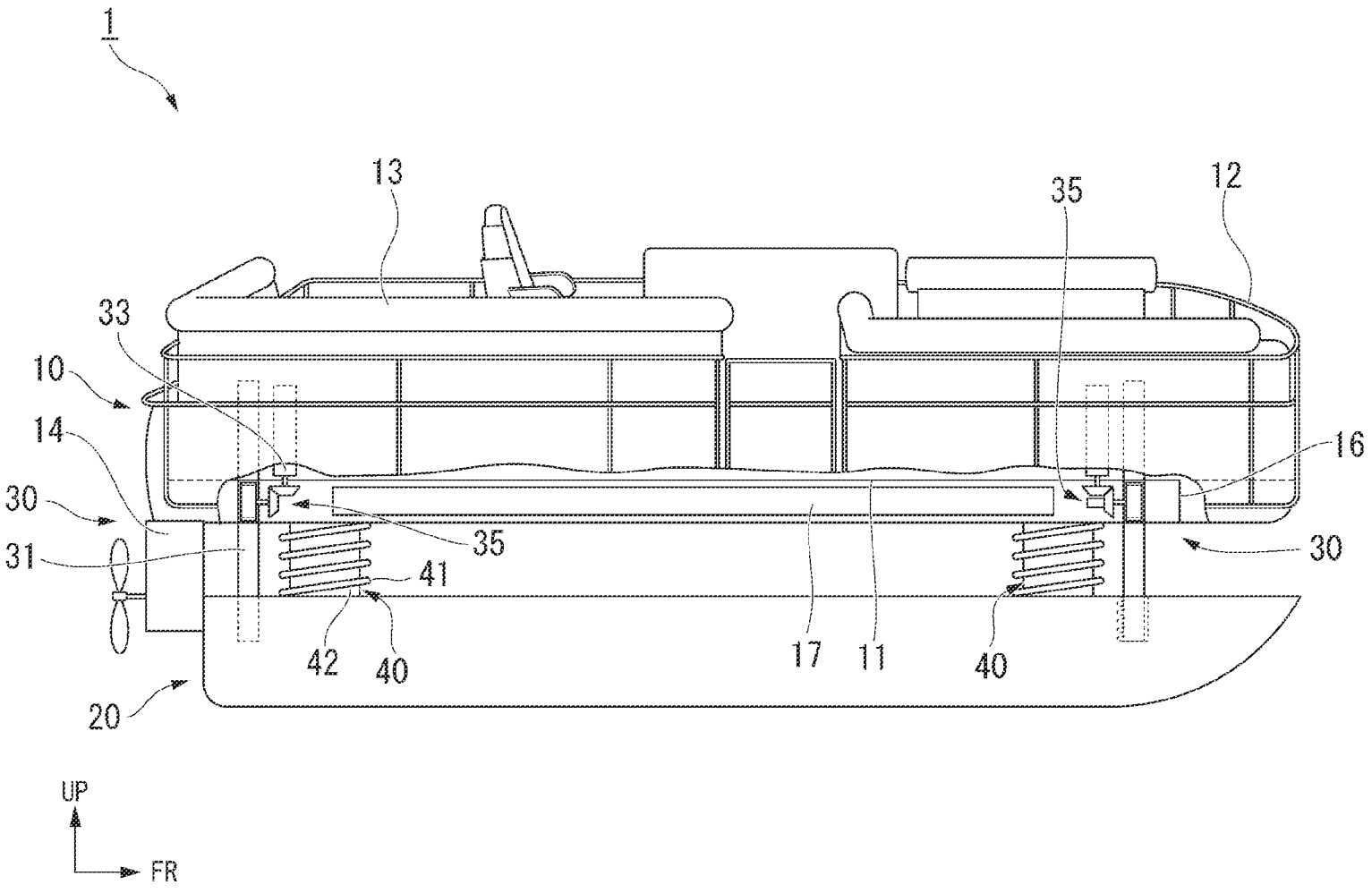
FIG. 3 is a side view of a boat according to a second embodiment.
Figure 4:
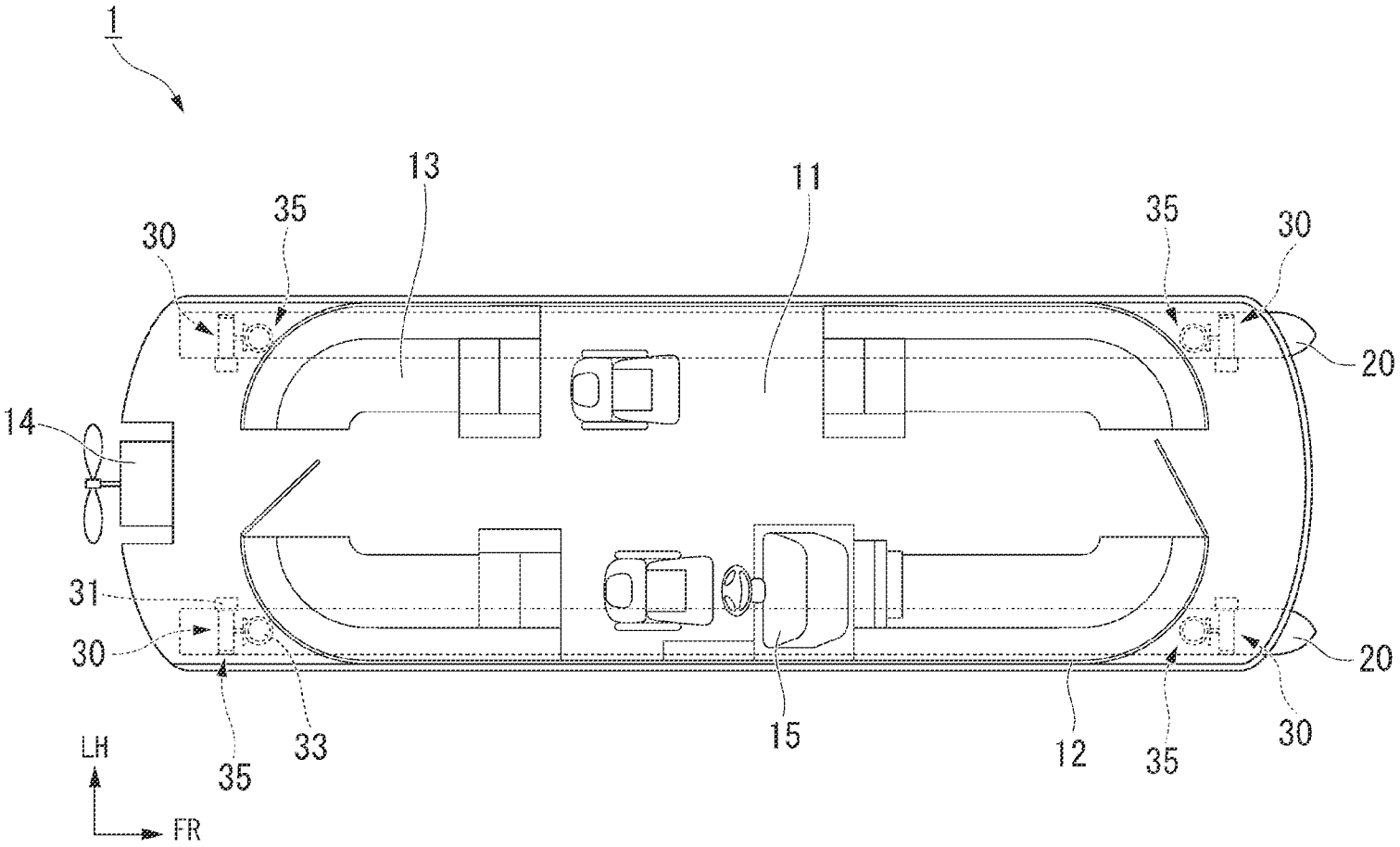
FIG. 4 is a top view of the boat of FIG. 3.
Figure 5A:
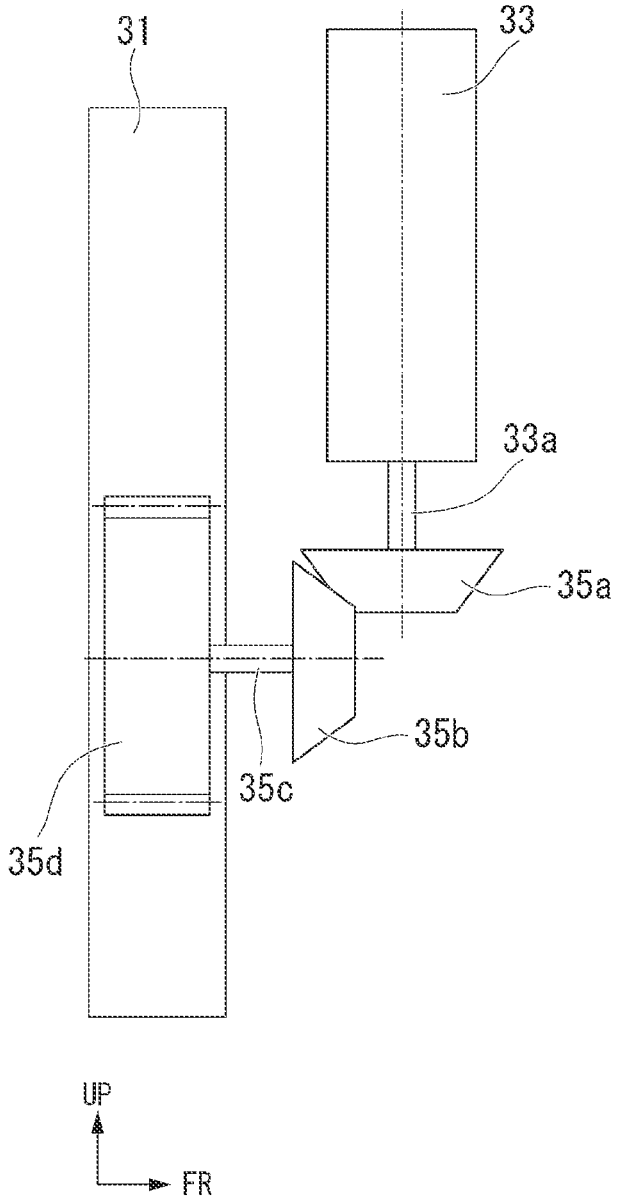
FIG. 5A is an enlarged view of the vicinity of a gear train of FIG. 3.
Figure 5B:
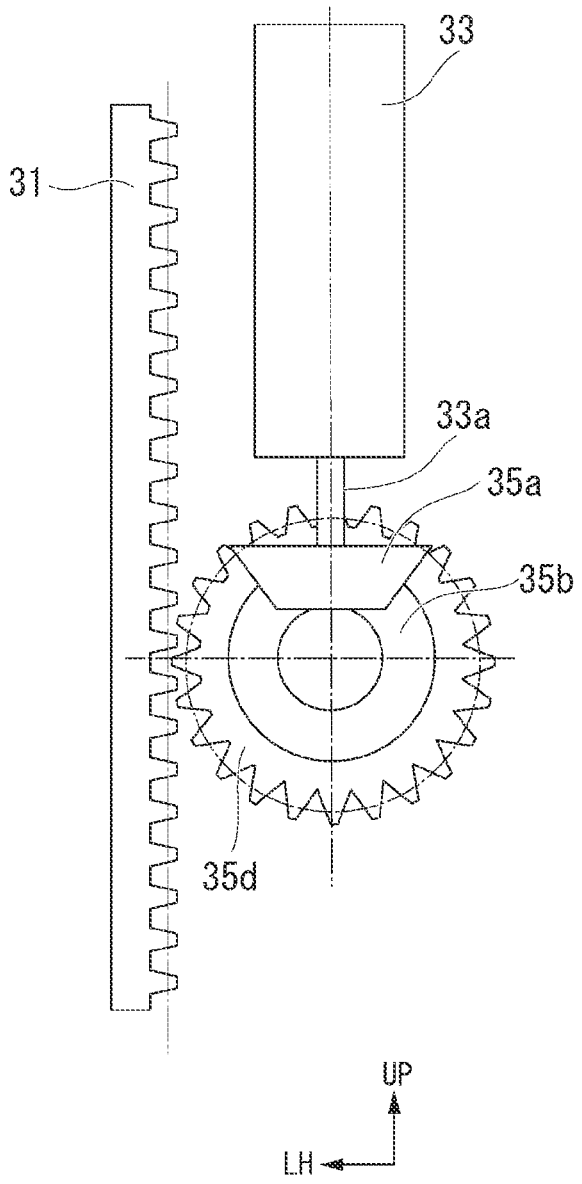
FIG. 5B is a view of the vicinity of the gear train of FIG. 5A when seen from a forward direction.
Figure 5C:
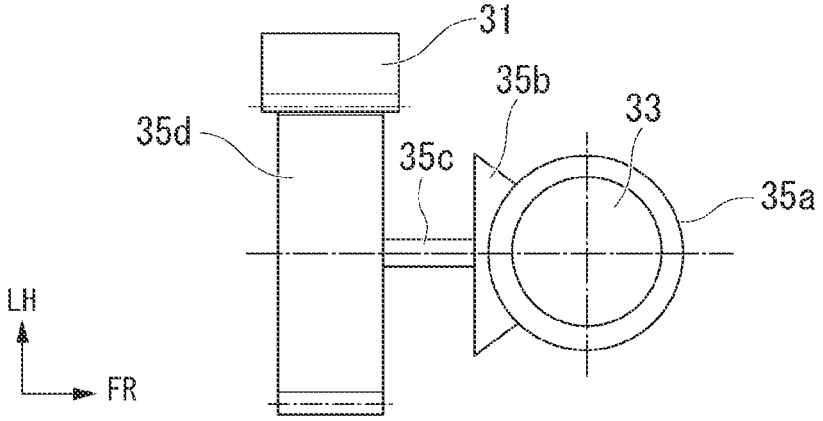
FIG. 5C is a view of the vicinity of the gear train of FIG. 5A when seen from an upward direction.

As shown in FIG. 3, the rotation shaft 33*a* of the motor 33 in the present embodiment extends in the vertical direction. As shown in FIG. 4, each conversion mechanism 30 includes a gear train 35 that connects the motor 33 to the rack gear 31. As shown in FIG. 5A to FIG. 5C, the gear train 35 includes a first bevel gear 35*a*, a second bevel gear 35*b*, a connection shaft 35*c*, and a pinion gear 35*d*. The first bevel gear 35*a* is fixed to the rotation shaft 33*a*. The first bevel gear 35*a* and the rotation shaft 33*a* integrally rotate. The second bevel gear 35*b* engages with the first bevel gear 35*a*. The connection shaft 35*c* extends in a direction (the forward-rearward direction in FIG. 5A) perpendicular to the vertical direction. The second bevel gear 35*b* and the pinion gear 35*d* are fixed to first and second end parts of the connection shaft 35*c*, respectively. The second bevel gear 35*b*, the connection shaft 35*c*, and the pinion gear 35*d* integrally rotate. The pinion gear 35*d* engages with the rack gear 31. The gear train 35 converts a rotational motion around a center axis line of the rotation shaft 33*a* that extends in the vertical direction into a vertical motion of the pinion gear 35*d* relative to the rack gear 31.

As described above, the conversion mechanism 30 of the present embodiment includes: the rack gear 31 that is fixed to the float 20 and is movable upward and downward relative to the hull 10; the motor 33 having the rotation shaft 33*a*; and the gear train 35 that connects the rotation shaft 33*a* to the rack gear 31, the hull 10 includes the battery 17 that is electrically connected to the motor 33, and the rotation shaft 33*a* extends in the vertical direction.

In this way, by employing an arrangement in which the rotation shaft 33*a* of the motor 33 extends in the vertical direction, the proprietary area of the conversion mechanism 30 can be made small when seen from the vertical direction.

Thereby, it is possible to further effectively utilize the space of the hull 10. For example, as shown in FIG. 4, when the conversion mechanism 30 is arranged on the back side of the corner part of the seat 13 which is a round sofa, it is possible to avoid narrowing of the space of an upper part of the hull 10 by the conversion mechanism 30. A component of the conversion mechanism 30 such as the motor 33 may be arranged at an upper position than the floor part 11 and be covered by a waterproof cover for preventing entering of water.

The technical scope of the present invention is not limited to the embodiments described above, and various modifications can be made without departing from the scope of the present invention.

For example, the above embodiment is described using an example in which electricity is generated by using the conversion mechanism 30, and the battery 17 is charged. However, the conversion mechanism 30 may be used for other applications such as improving boarding performance by adjusting the height of the pier and the floor part 11 at the time of berthing of the boat 1 or improving the riding comfort of the occupant by tilting the hull 10 inward at the time of turning.

The components in the embodiments described above can be appropriately replaced by known components without departing from the scope of the present invention, and the embodiments described above and modification examples may be suitably combined.

What is claimed is:

1. A boat comprising:

a hull;

a float that supports the hull;

a suspension that is disposed between the hull and the float and absorbs a vibration transmitted from the float to the hull; and a conversion mechanism that converts an energy generated in accordance with a relative movement of the hull and the float in a vertical direction, wherein the conversion mechanism is arranged so as to sandwich a center of gravity of the hull in a forward-rearward direction, when a distance from the center of gravity of the hull to the conversion mechanism located at a rearward position is X, and a distance from the center of gravity of the hull to the conversion mechanism located at a forward position is Y, a relationship of X>Y is satisfied, the conversion mechanism includes: a rack gear that is fixed to the float and is movable upward and downward relative to the boat; a pinion gear that engages with the rack gear; and a motor having a rotation shaft to which the pinion gear is fixed, the hull includes a battery that is electrically connected to the motor, the rotation shaft extends in a direction perpendicular to the vertical direction, a size of the motor is smaller than a size of the battery in the vertical direction, and the motor and the battery are stored in a storage room.

2. The boat according to claim 1, wherein the conversion mechanism includes a motor that generates an electric energy in accordance with the relative movement of the hull and the float in the vertical direction, the motor is electrically connected to a battery, and a center of gravity of the battery and a center of gravity of the hull match with each other in the forward-rearward direction.

3. The boat according to claim 1, wherein the conversion mechanism includes: a rack gear that is fixed to the float and is movable upward and downward relative to the hull; a motor having a rotation shaft; and a gear train that connects the rotation shaft to the rack gear, the hull includes a battery that is electrically connected to the motor, and the rotation shaft extends in the vertical direction.

* * * * *